US007486008B2

(12) United States Patent
Kim et al.

(10) Patent No.: US 7,486,008 B2
(45) Date of Patent: Feb. 3, 2009

(54) MASK ASSEMBLY FOR CATHODE RAY TUBE (CRT)

(75) Inventors: Jong-Heon Kim, Suwon-si (KR); Hyung-Seok Oh, Suwon-si (KR); Sang-Shin Choi, Suwon-si (KR); Min-Boum Hyun, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 361 days.

(21) Appl. No.: 11/377,358

(22) Filed: Mar. 17, 2006

(65) Prior Publication Data

US 2006/0226756 A1 Oct. 12, 2006

(30) Foreign Application Priority Data

Apr. 8, 2005 (KR) ..... 10-2005-0029463

(51) Int. Cl.
*H01J 29/80* (2006.01)

(52) U.S. Cl. ..... 313/407; 313/402

(58) Field of Classification Search ..... 313/400–410
See application file for complete search history.

(56) References Cited

U.S. PATENT DOCUMENTS 5,698,938 A * 12/1997 Kim et al. ..... 313/407
6,046,535 A * 4/2000 Jung ..... 313/402
6,384,522 B1 * 5/2002 Tani et al. ..... 313/402
6,577,049 B1 * 6/2003 Kim et al. ..... 313/407
6,724,136 B1 * 4/2004 Kim et al. ..... 313/402
6,998,765 B2 * 2/2006 Kim ..... 313/402
7,012,357 B2 * 3/2006 Kim ..... 313/402

FOREIGN PATENT DOCUMENTS

KR 10-2005-0028284 3/2005

* cited by examiner

*Primary Examiner*—Nimeshkumar D Patel
*Assistant Examiner*—Mary Ellen Bowman
(74) *Attorney, Agent, or Firm*—Robert E. Bushnell, Esq.

(57) ABSTRACT

A mask assembly for a Cathode Ray Tube (CRT) includes a shadow mask with a plurality of beam passage holes, and a frame including a supporting portion with a pair of long sides and a pair of short sides which fix the shadow mask and a strength maintenance portion bent from the supporting portion. The frame includes a plurality of reinforcement indentations formed on a portion of the boundary between the supporting portion and the strength maintenance portion. At least one of the reinforcement indentations satisfies the following condition:

$$\frac{S_1}{3} \le S_2 \le \frac{2}{3} S_1$$

wherein $S_1$ represents an area of a triangle defined by a width of the supporting portion including the reinforcement indentation, a width of the strength maintenance portion including the reinforcement indentation and an imaginary line connecting an end of the supporting portion and an end of the strength maintenance portion, and wherein $S_2$ represents a sectional area of the reinforcement indentation.

13 Claims, 10 Drawing Sheets

MASK ASSEMBLY FOR CATHODE RAY TUBE (CRT)

CLAIM OF PRIORITY

This application makes reference to, incorporates the same herein, and claims all benefits accruing under 35 U.S.C. §119 from an application earlier filed in the Korean Intellectual Property Office on 8 Apr. 2005 and there duly assigned Serial No. 10-2005-0029463.

BACKGROUND OF THE INVENTION

1. Field of the Invention

The present invention relates to a mask assembly for a Cathode Ray Tube (CRT), and more particularly, to a mask assembly for a CRT which can minimize the transference of vibration through a frame.

2. Description of the Related Art

Generally, a Cathode Ray Tube (CRT) is an electronic tube where electron beams emitted from an electron gun are deflected due to a magnetic deflection field, pass through a color selection shadow mask, and then strike and excite green, blue, and red phosphors on a phosphor screen within a panel, thereby displaying desired images.

In the CRT, the mask assembly comprises a shadow mask and a frame which is the supporting body of the shadow mask.

The shadow mask is formed such a way that a plurality of beam passage holes are formed on a metal plate through a photolithography process, and the circumference of the frame is bent through a pressing process. The frame is fixed to the circumference of the shadow mask through a method such as welding.

A plurality of spring members are attached on the outer circumference portion of the frame, and the mask assembly is built in a CRT in such a way that the spring members are inserted into a stud pin fixed in a panel.

The shadow mask has a color selection function of selecting the emitted electron beams and landing them on the phosphor screen.

For this purpose, it is important that the beam passage holes maintain a predetermined pattern to guarantee high image quality.

Since the shadow mask is very thin and weak, transference of the vibration to the shadow mask should be minimized when shocks or vibrations due to the sound pressure of speakers are applied to the shadow mask.

To prevent the transference of the vibration, the thickness of the frame can be increased. But in this case, the weight of the mask assembly will be also increased, so another method to improve the strength while not increasing the weight of the frame is needed.

SUMMARY OF THE INVENTION

It is an object of the present invention to provide a mask assembly for a Cathode Ray Tube (CRT) that can improve strength and vibration absorbing ability of the frame by reforming the structure of the frame.

This and other objects can be achieved by a mask assembly for a CRT with the following features.

A mask assembly for a CRT according to the exemplary embodiment of the invention can include a shadow mask with a plurality of beam passage holes, a frame including a supporting portion with a pair of long sides and a pair of short sides fixed to the shadow mask, and a strength maintenance portion bent and formed from the supporting portion.

The frame can include a plurality of reinforcement indentations formed on a portion of the boundary between the supporting portion and the strength maintenance portion.

At least one of the reinforcement indentations can satisfy the following conditions:

$$a \le \frac{L_H}{6},\ b \ge \frac{L_H}{3}$$

$$a' \le \frac{L_V}{5},\ b' \ge \frac{3}{10}L_V$$

wherein a and b respectively represent the distance from the end of the long side of the frame to one side and to the other side of the reinforcement indentation located on the long side of the frame, a' and b' respectively represent the distance from the end of the short side of the frame to one side and to the other side of the reinforcement indentation located on the short side of the frame, and wherein $L_H$ and $L_V$ respectively represent the lengths of the long side and of the short side of the frame.

In addition, the reinforcement indentation can include first indentations located on the center of the long and the short sides of the frame, second indentations located next to the first indentations and at a predetermined distance from the first indentations, and third indentations located on the four corners of the frame.

At least one of the second indentations can satisfy at least one of the conditions described above.

Furthermore, the mask assembly for a CRT according to the exemplary embodiment of the present invention can include a shadow mask with a plurality of beam passage holes, a frame including a supporting portion with a pair of long sides and a pair of short sides fixed to the shadow mask, and a strength maintenance portion bent and formed from the supporting portion.

The frame can include a plurality of reinforcement indentations formed on a portion of a boundary between the supporting portion and the strength maintenance portion.

At least one of the reinforcement indentations can satisfy the following condition:

$$\frac{S_1}{3} \le S_2 \le \frac{2}{3}S_1$$

wherein $S_1$ represents the area of a triangle defined by the whole width of the supporting portion that includes the reinforcement indentation, the whole width of the strength maintenance portion that includes the reinforcement indentation and the imaginary line connecting the ends of the supporting portion and the strength maintenance portion, and wherein $S_2$ represents the sectional area of the reinforcement indentation.

The reinforcement indentation can include first indentations located on the center of the long and the short sides of the frame, second indentations located next to the first indentations at a predetermined distance from the first indentations, and third indentations located on the four comers of the frame.

At least one of the second indentations can satisfy the condition described above.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully hereinafter with reference to the accompanying drawings, in which a certain exemplary embodiment of the present invention is shown.

Figure 1:
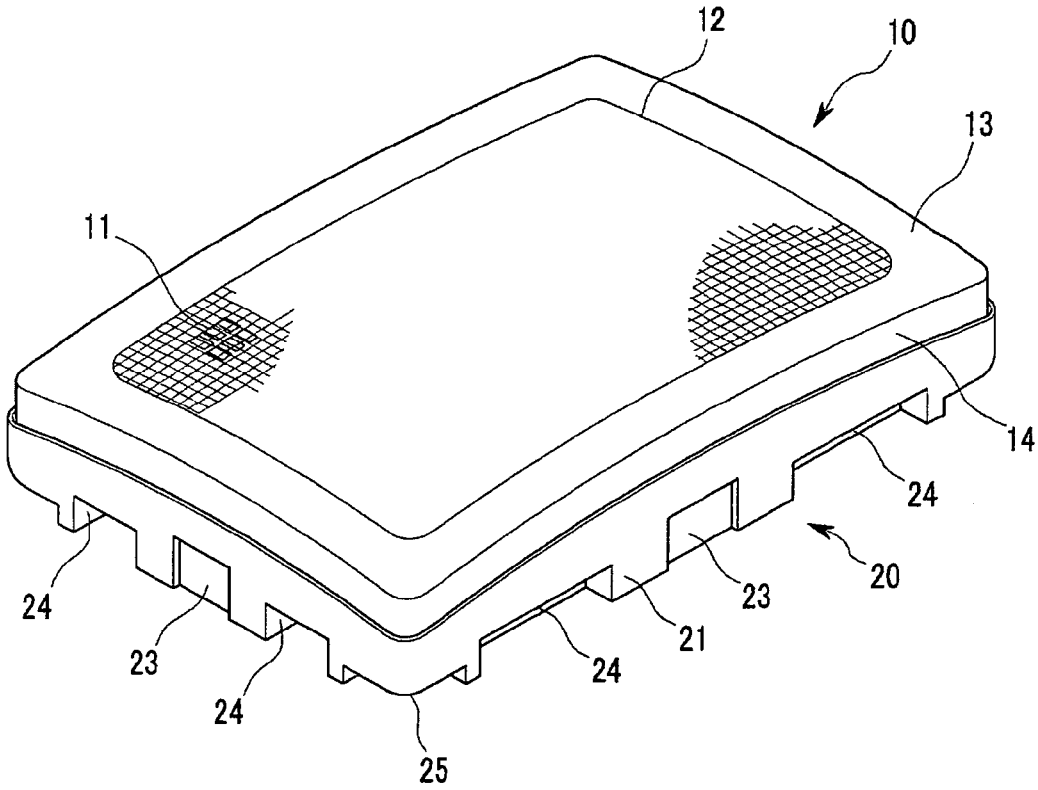
FIG. 1 is a perspective view of a mask assembly for a Cathode Ray Tube (CRT) according to an exemplary embodiment of the present invention.
Figure 2:
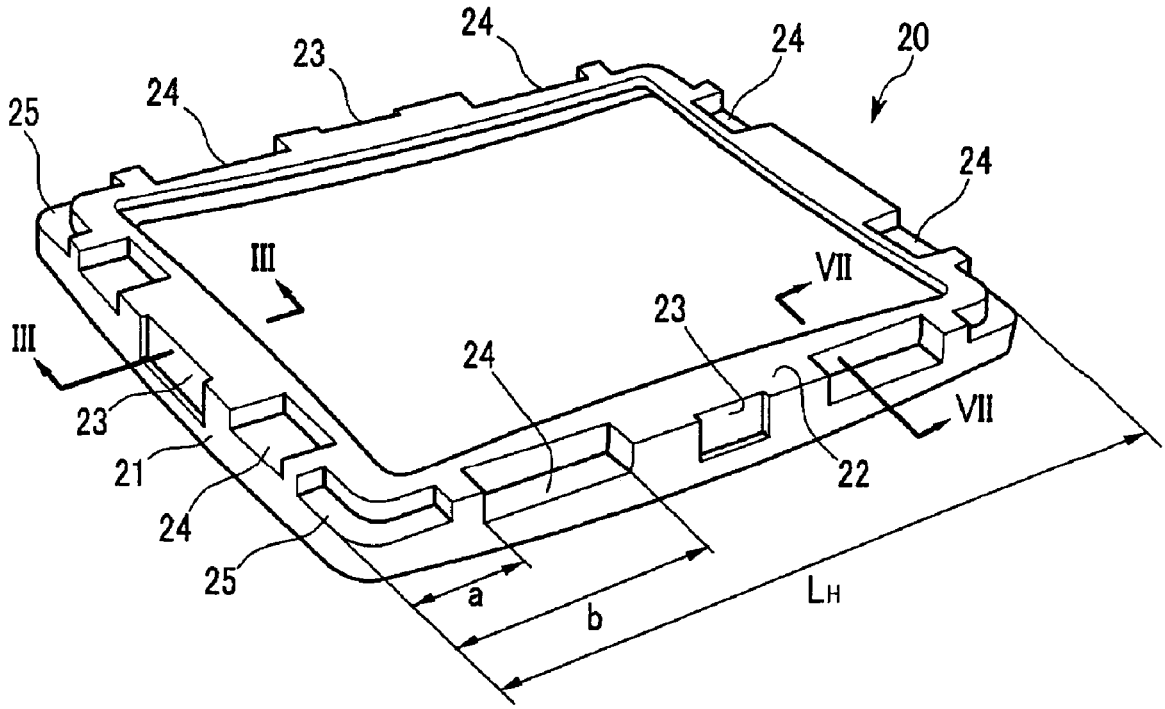
FIG. 2 is a perspective view of a frame according to the exemplary embodiment of the present invention.

FIG. 1 is a perspective view of a mask assembly for a Cathode Ray Tube (CRT) according to an exemplary embodiment of the present invention, and FIG. 2 is a perspective view of a frame 20 showing a strength maintenance portion 22 arranged toward the upper portion of the drawing.

As shown in the drawings, the mask assembly for a CRT includes a shadow mask 10 with a plurality of beam passage holes 11 and the frame 20 that is fixed to the shadow mask 10 and supports it.

The shadow mask 10 includes a holed portion 12 constituting an effective screen portion, a non-holed portion 13 surrounding the holed portion 12, and a skirt portion 14 bent to extend from the non-holed portion 13 to the frame 20.

The holed portion 12 has a plurality of beam passage holes 11, and the shadow mask 10 is formed of Invar or an aluminum killed steel, for example.

The frame 20 includes a supporting portion 21 attached to the skirt portion 14 of the shadow mask 10, and the strength maintenance portion 22, having a predetermined width, and bent to extend from the supporting portion 21 to the inside of the frame 20.

The supporting portion 21 has a pair of long sides and a pair of short sides corresponding to the shape of the skirt portion 14.

A plurality of reinforcement indentations 23, 24, and 25 are formed on a portion of a boundary between the supporting portion 21 and the strength maintenance portion 22.

The frame 20 with the above structure can be made by deforming sheet metal by deep drawing, or by attaching an L-shaped metal sheet by welding and deforming the reinforcement indentations 23, 24, and 25 by a deep drawing process.

The shadow mask 10 and the frame 20 are attached to each other by welding the skirt portion 14 of the shadow mask 10 to the supporting portion 21 of the frame 20.

In the present embodiment, three reinforcement indentations (one indentation 23 and two indentations 24) are arranged on each of the sides of the frame 20, and a reinforcement indentation 25 is arranged on each corner of the frame 20.

More specifically, the reinforcement indentations 23, 24, and 25 include first indentations 23 located on the middle of the long sides and the short sides of the frame 20, second indentations 24 located on either side of and at a predetermined distance from the first indentations 23, and third indentations 25 located on the corners of the frame 20 at a predetermined distance from the second indentations 24.

The first indentations 23 and the second indentations 24 are elongated in a straight line, and the third indentations 25 are L-shaped such that they wrap around the corners of the frame 20. The reinforcement indentations can be arranged in bilateral symmetry with respect to the center of the sides.

Figure 3:
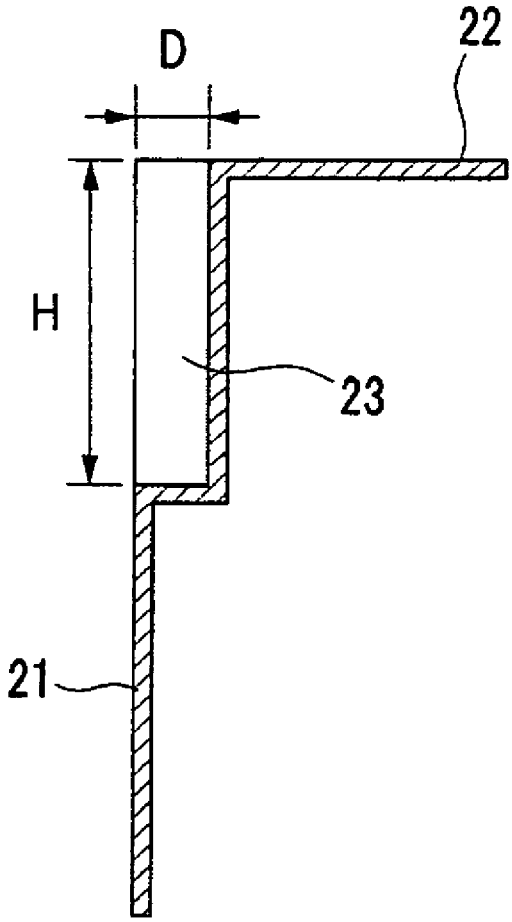
FIG. 3 is a sectional view of FIG. 2 taken along the line III-III.

FIG. 3 is a sectional view of the height and the protrusion depth of the reinforcement indentations 23, 24, and 25. In the drawing, H represents the height of the first indentation 23 and D represents the protrusion depth thereof in the direction toward the inside of the frame 20.

The height of the reinforcement indentations 23, 24, and 25 is measured according to the direction of the width of the supporting portion 21, and the protrusion depth of the reinforcement indentation 23, 24, and 25 is defined by the depth measured in the direction of the width of the strength maintenance portion 22.

In the present embodiment, at least two of the reinforcement indentations 23, 24, and 25 have different heights from each other. For instance, the height of the third indentation 25 is less than that of the first indentation 23 and the second indentation 24.

Since the third indentation 25 is substantially L-shaped, it can provide enough strength reinforcement in spite of its lesser height than that of the elongated first and second indentations 23 and 24.

The first indentation 23 and the second indentation 24 on each of the long and short sides of the frame 20 can also have different heights from each other. The drawings show that the first indentation 23 has greater height than that of the second indentation 24, as an example.

In addition, at least two of the reinforcement indentations 23, 24, and 25 can have different protrusion depths from each other.

For instance, the protrusion depth of the second indentation 24 can be greater than that of the first and third indentations 23 and 25, and the protrusion depth of the third indentation 25 can be greater than that of the first indentation 23.

It is more effective for the reinforcement of strength to have the protrusion depths of the second and third indentations 24 and 25 be greater than that of the first indentation 23.

In the frame 20 with the above structure, the second indentation 24 can satisfy at least one of the following conditions regarding the length, position, and volume according to its height and protrusion depth with respect to improving the strength of the frame 20.

The condition regarding the length and the position of the second indentation 24 located on the long sides is described below.

As shown in FIG. 2, a represents the distance from the end of the long sides of the frame 20 to one side of the second indentation 24, and b represents the distance from the end of the long side of the frame 20 to the other side of the second indentation 24.

In this situation, the second indentation 24 satisfies the following Formula 1:

$$a \le \frac{L_H}{6},\ b \ge \frac{L_H}{3} \tag{1}$$

wherein $L_H$ represents the length of the long sides of the frame 20.

Figure 4A:
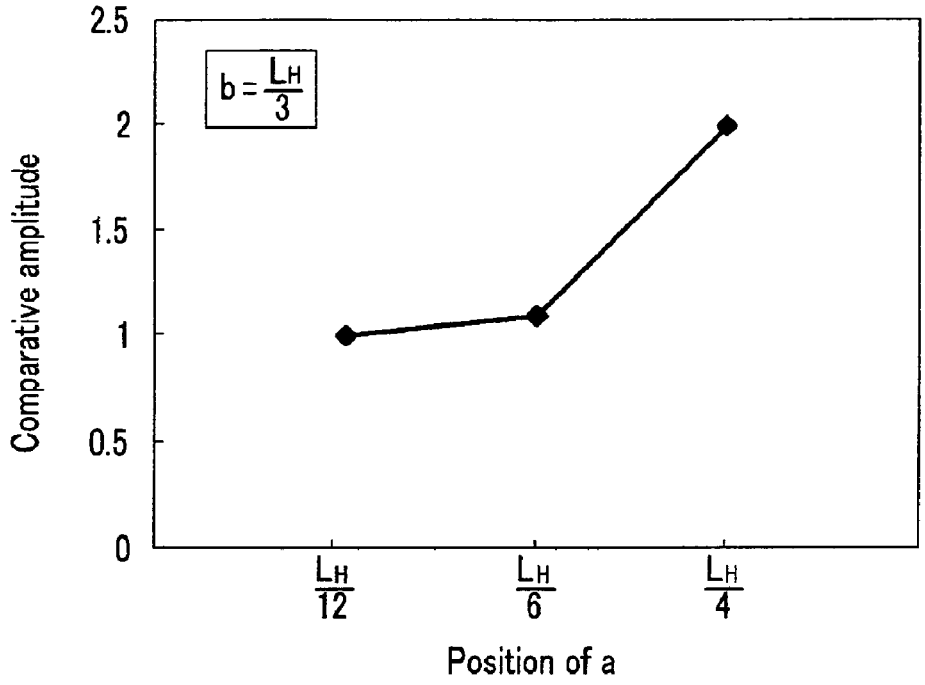
FIGS. 4A and 4B are graphs of the amplitudes at the welding point on a long side of the frame according to the position of a second indentation.
Figure 4B:
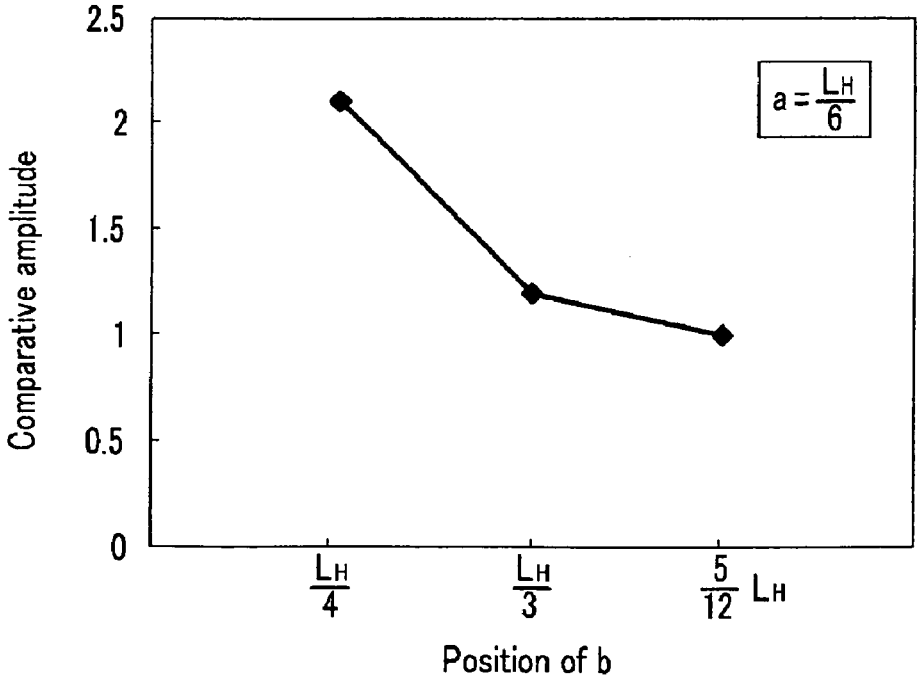

FIGS. 4A and 4B are graphs of the amplitudes at the welding point on a long side of the shadow mask 10 according to the position of the second indentation 24 while vibrations are applied to the long side of the frame 20.

The welding point at which the amplitude was measured is located on the long side of the frame 20 (hereinafter, referred to as the "long side welding point").

More specifically, FIG. 4A is a graph of the amplitude on the long side welding point while a is varied to be $L_H/12$, $L_H/6$, and $L_H/4$, and b is fixed at $L_H/3$.

FIG. 4B is a graph of the amplitude on the long side welding point while b is varied to be $L_H/4$, $L_H/3$, and $5L_H/12$, and a is fixed at $L_H/6$.

In FIG. 4A, the values indicating the amplitude of the long side welding point are values that are comparative to the value measured when the distance a is $L_H/12$. In FIG. 4B, the values indicating the amplitude of the long side welding point are values that are comparative to the value measured when the distance b is $5L_H/12$.

As shown in the FIGS. 4A and 4B, while the same condition of vibration is given, when the distance a is above $L_H/6$, the amplitude on the long side welding point rises abruptly, and when the distance b is less than $L_H/3$, the amplitude on the long side welding point rises abruptly.

The rises of the amplitude on the long side welding point represent the shaking of the shadow mask 10. Accordingly, the characteristics of the image quality deteriorate due to the change of the position of the beam passage holes 11.

However, when the second indentation 24 located on the long side of the frame 20 satisfies Formula 1, the shaking of the shadow mask 10 is effectively prevented by absorbing the vibration applied to the long side of the frame 20.

The conditions regarding the length and the position of the second indentation 24 are described below.

Figure 5:
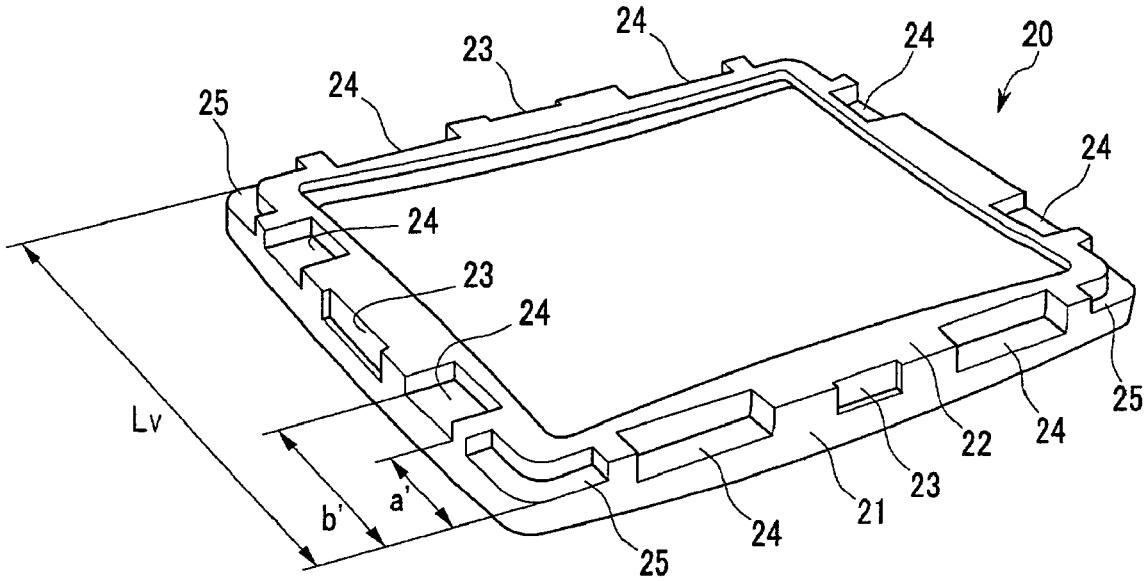
FIG. 5 is a perspective view of the frame according to the exemplary embodiment of the present invention.

As shown FIG. 5, a' represents the distance from the end of the short side to one side of the second indentation 24, and b' represents the distance from the end of the short side to the other side of the second indentation 24. In this situation, the second indentation 24 satisfies the following Formula 2:

$$a' \le \frac{L_V}{5},\ b' \ge \frac{3}{10}L_V \tag{2}$$

wherein $L_V$ represents the length of the short sides of the frame 20.

Figure 6A:
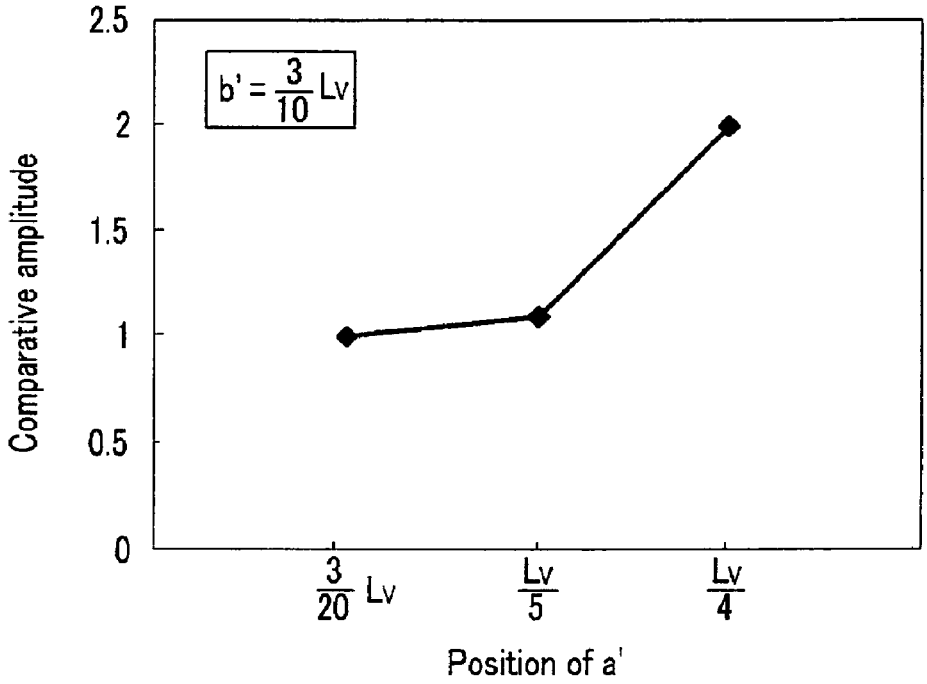
FIGS. 6A and 6B are graphs of the amplitudes at the welding point on a short side of the frame according to the position of the second indentation.
Figure 6B:
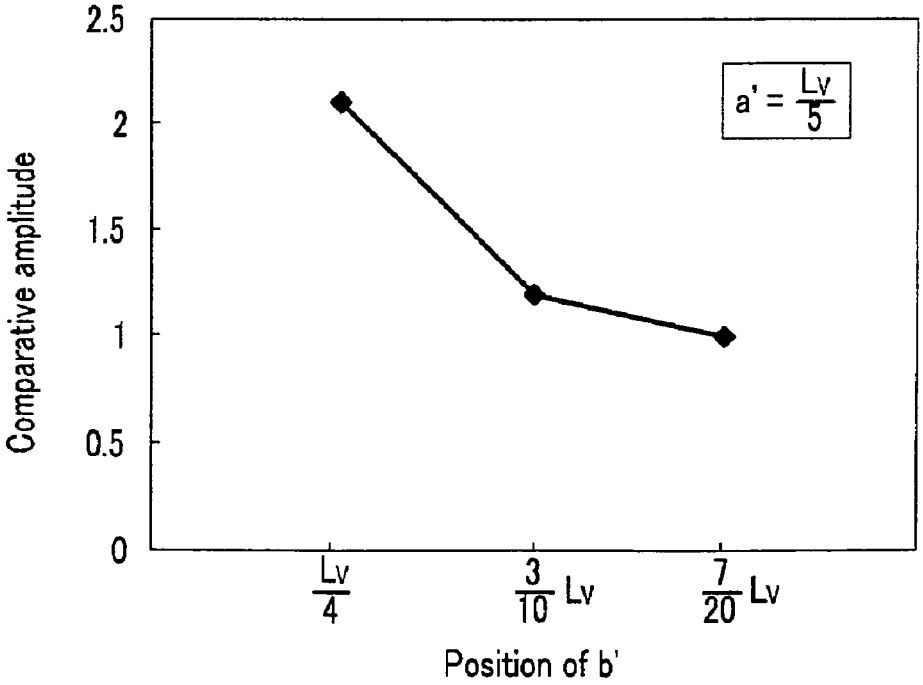

FIGS. 6A and 6B are graphs of amplitudes at the welding point on the shadow mask 10 and the frame 20 according to the position of the second indentation 24.

The welding point at which the amplitude of vibration was measured is located on the short side of the frame 20 (hereinafter, referred to as the "short side welding point").

More specifically, FIG. 6A is a graph of the amplitude on the short side welding point while a' is varied to $3L_V/20$, $L_V/5$, and $L_V/4$ and b' is fixed as $3L_V/10$.

FIG. 6B is a graph of the amplitude on the short side welding point while b' is varied as $L_V/4$, $3L_V/10$ and $7L_{HV}/20$ and a' is fixed as $L_V/5$.

In FIG. 6A, the values indicating the amplitude of the short side welding point are values that are comparative to the value measured when the distance a' is $3L_V/20$. In FIG. 6B, the values indicating the amplitude of the short side welding point are values that are comparative to the value measured when the distance b' is $7L_V/20$.

As shown in FIGS. 6A and 6B, while the same condition of vibration is applied, when the distance a' is above $L_V/5$, the amplitude on the short side welding point rises abruptly, and when the distance b' is less than $3L_V/10$, the amplitude on the short side welding point rises abruptly.

The rises of the amplitude on the short side welding point also represent the shaking of the shadow mask 10. Accordingly, the characteristics of the image quality are deteriorated due to the change of the position of the beam passage holes 11.

However, when the second indentation 24 located on the short side of the frame 20 satisfies Formula 2, the shaking of the shadow mask 10 is effectively prevented by absorbing the vibration applied to the short side of the frame 20.

The volume conditions of the second indentation 24 are described hereinafter.

Figure 7:
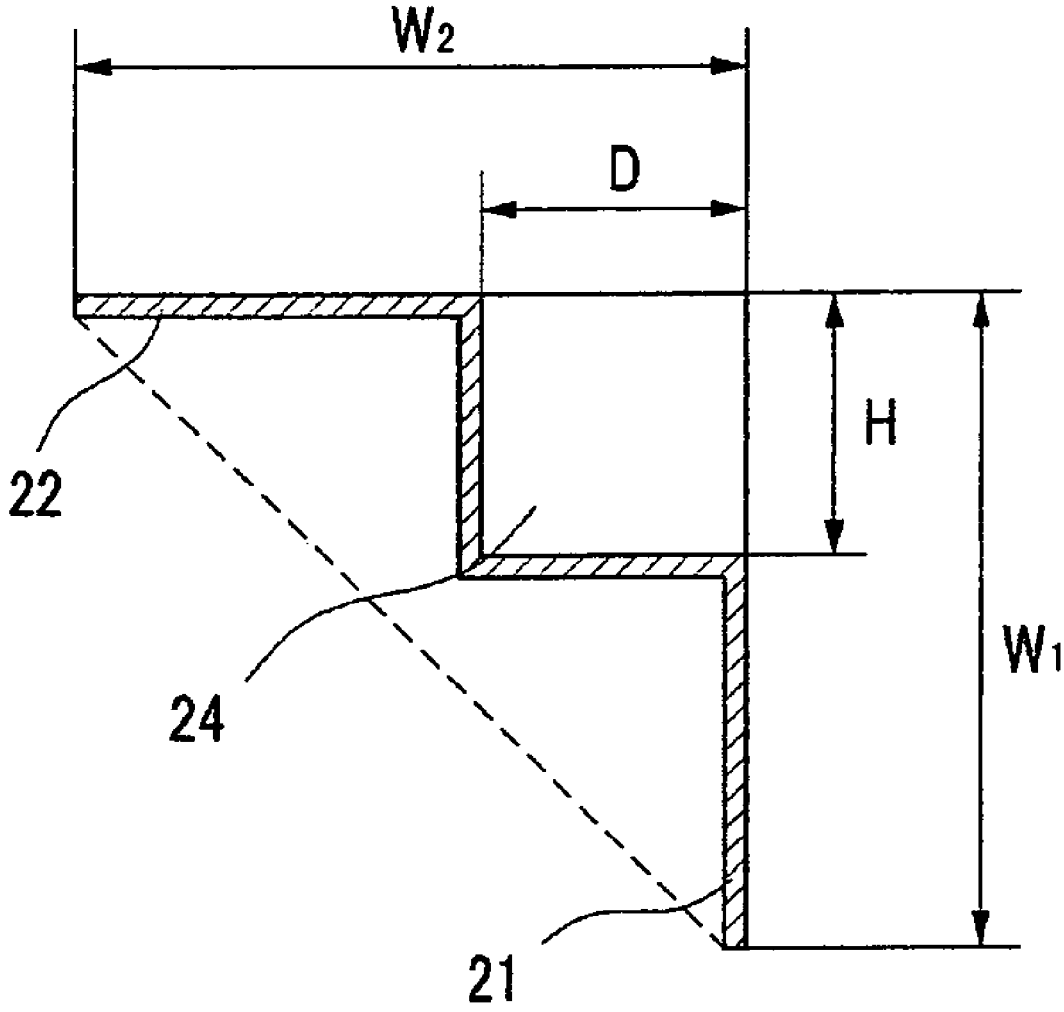
FIG. 7 is a sectional view of FIG. 2 taken along the line VII-VII.

FIG. 7 is a sectional view of FIG. 2 taken along the line VII-VII, and in the drawing, H represents the height of the second indentation 24, and D represents the protrusion depth of the second indentation 24 toward the inside of the frame 20.

Although FIG. 7 shows the second indentation 24 located at the long side of the frame 20 as an example, the following volume condition of the second indentation 24 is also applied to the second indentations 24 located on the short side of the frame 20.

In FIG. 7, a triangle is defined by an imaginary line connecting the end of the supporting portion 21 and the end of the strength maintenance portion 22, the whole width of the supporting portion W1 comprising the height of the second indentation H and the whole width of the strength maintenance portion $W_2$ comprising the protrusion depth of the second indentation D.

Figure 8:
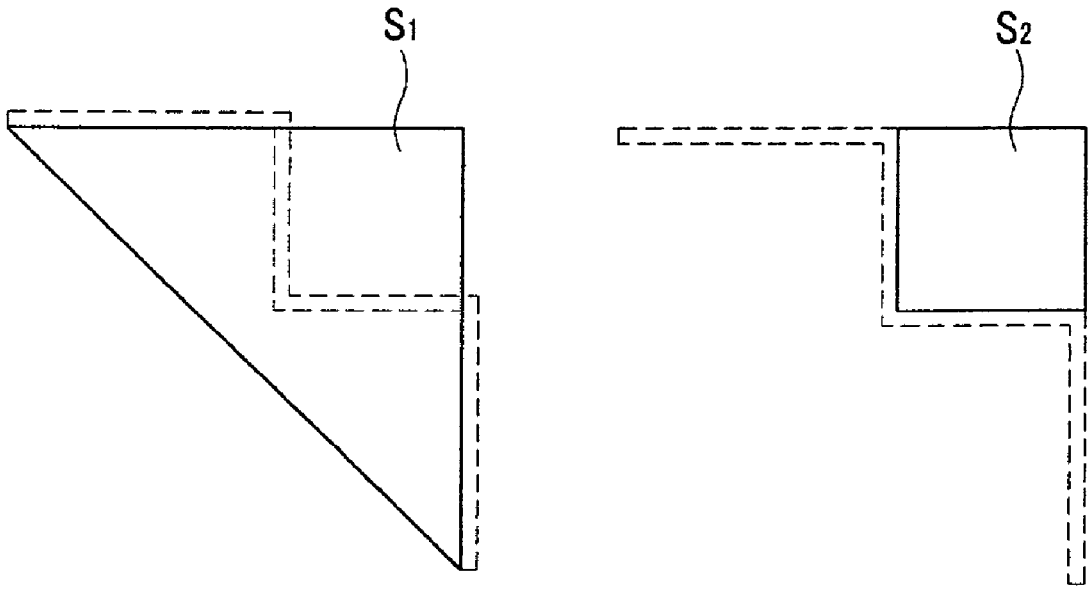
FIG. 8 is a schematic view of areas S1 and S2 in the frame according to the exemplary embodiment of the present invention.

In FIG. 8, $S_1$ represents the area of the triangle, and $S_2$ represents the sectional area of the second indentation 24.

The sectional area of the second indentation 24 $S_2$ is the product of the height H and the protrusion depth D of the second indentation 24, and that is applied when the sectional shape of the second indentation 24 is a square.

But the sectional shape of the second indentation 24 is not limited to the square shown in the drawings, and it can be a pentagon, a hexagon, or other various shapes.

In all of these cases, the area $S_2$ is defined as the sectional area of the second indentation 24 projected toward the inside of the frame 20, when it is shown as a section.

The second indentation 24 satisfies the following Formula 3:

$$\frac{S_1}{3} \le S_2 \le \frac{2}{3}S1 \tag{3}$$

An experiment was conducted in such a way that for the second indentation located on the long side of the frame, the amplitude on the long side welding point was measured while the vibration was applied to the long side of the frame, and for the second indentation located on the short side of the frame, the amplitude on the short side welding point was measured while the vibration was applied to the short side of the frame.

Figure 9:
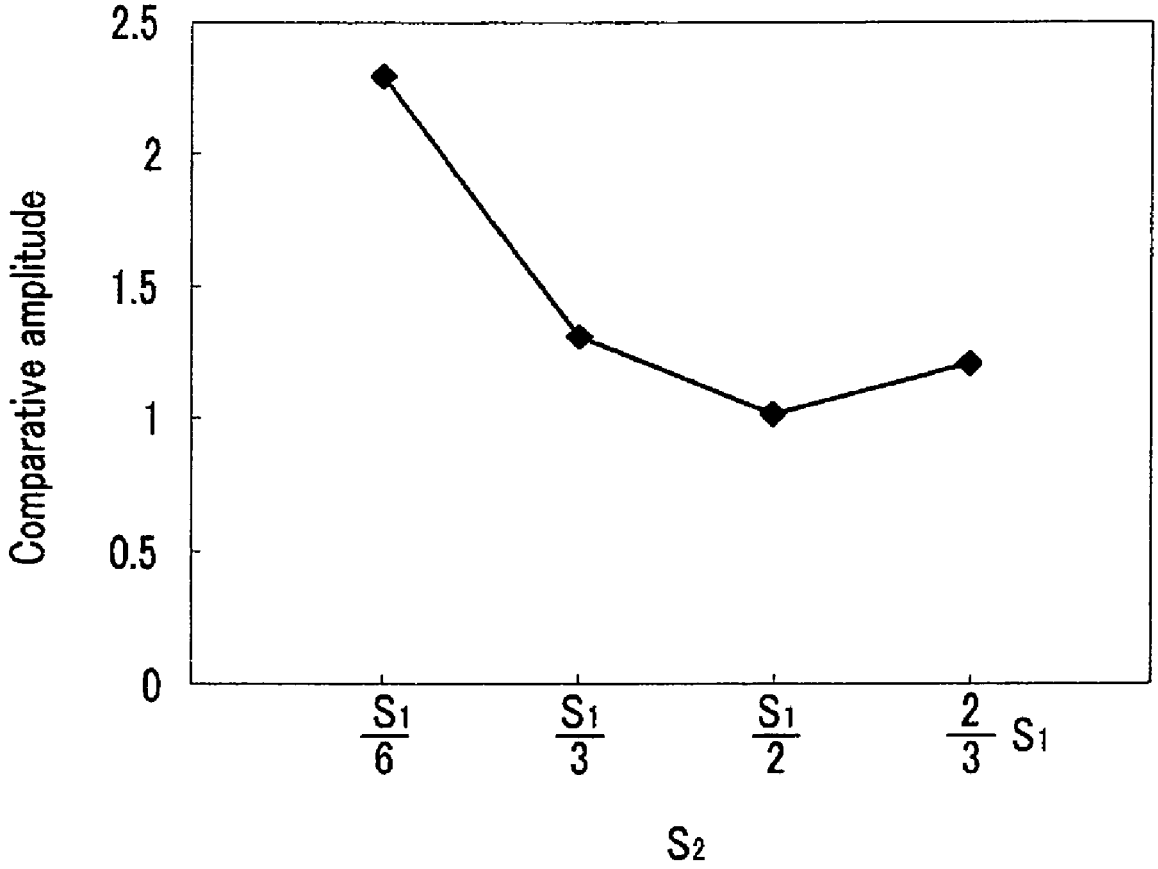
FIG. 9 is a graph of the amplitude at the welding point of the shadow mask and the frame according to the area of the second indentation.

In both cases, the results of the experiment were the same as shown in FIG. 9.

As shown in FIG. 9, on the same condition of vibration, when the sectional area of the second indentation is less than $S_1/3$, the amplitude on the welding point of the shadow mask and the frame rises abruptly.

Accordingly, it is desirable for the sectional area of the second indentation $S_2$ to be $S_1/3$ or more.

In addition, since the strength of the frame is reduced by the second indentation when the sectional area of the second indentation is more than $2s_1/3$, it is desirable for the sectional area of the second indentation $S_2$ to be $2s_1/3$ or less.

As described above, when the second indentation satisfies Formula 3, the strength and the vibration absorbing ability of the frame can be improved.

Figure 10:
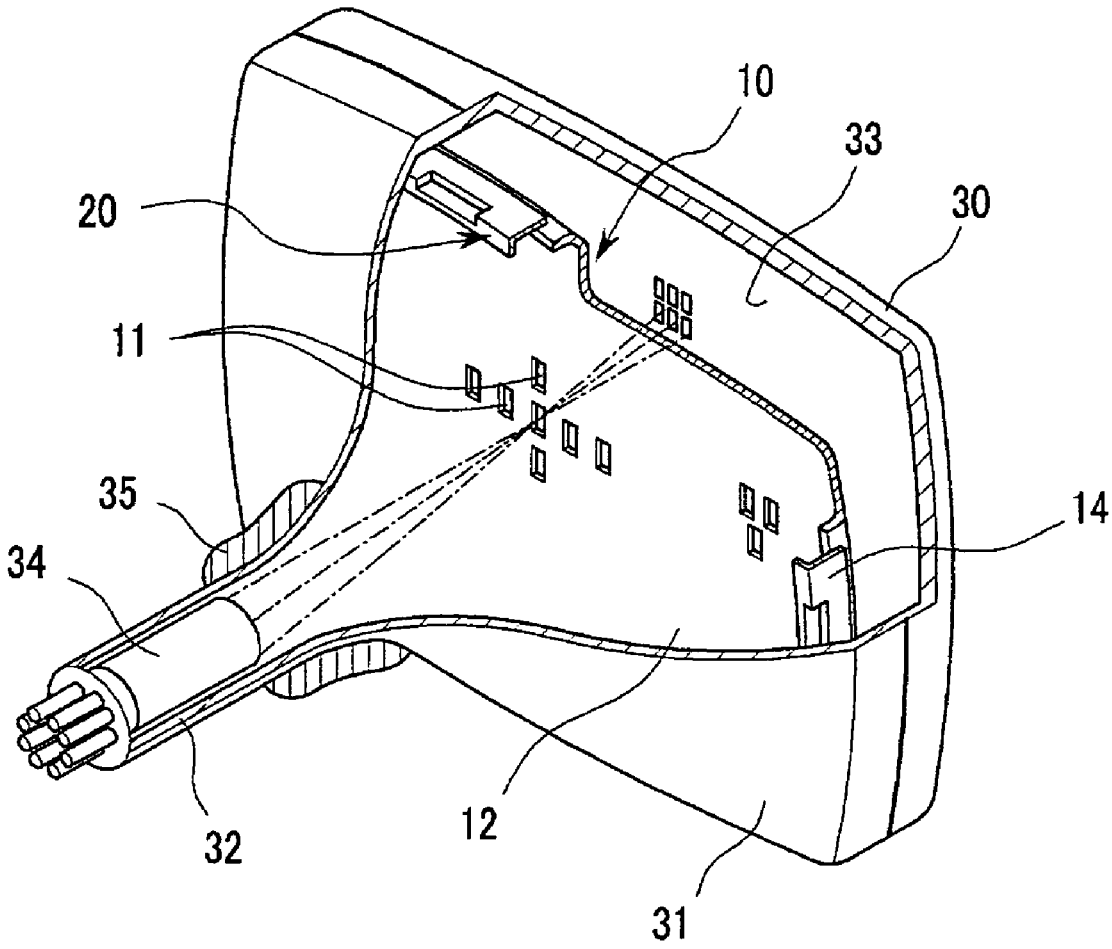
FIG. 10 is a partial sectional perspective view of a CRT adopting the mask assembly according to the exemplary embodiment of the present invention.

FIG. 10 is a perspective view of a CRT including the mask assembly according to the exemplary embodiment of the present invention.

As shown in the drawing, the CRT is formed by a vacuum vessel having a panel 30, a funnel 31, and a neck portion 32, and an electron gun 34, A deflection yoke 35 is arranged on the vacuum vessel.

A phosphor screen 33 is formed on the inner surface of the panel 30 with red R, green G, and blue B phosphors patterned while interposing a black matrix BM.

The mask assembly comprising the shadow mask 10 and the frame 20 is installed inside of the panel 30 such that it is spaced apart from the phosphor screen 33 by a predetermined distance.

With the CRT, the electron beams emitted by the electron gun 34 are deflected due to the deflection magnetic field of the deflection yoke 35, and pass through the beam passage holes 11 of the shadow mask 10 having a color selection function. The electron beams then collide against the green, blue, and red phosphors of the phosphor screen 33 formed on the inner surface of the panel 30. Consequently, the phosphors are excited to thereby display the desired images.

With the above structure, the mask assembly according to the present embodiment can minimize shaking of the shadow mask and deterioration of image quality due to the vibration by absorbing the vibration transferred to the frame.

The mask assembly according to the present invention has more effect when it is applied to a CRT having a deflection angle of 110 degrees.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A mask assembly for a Cathode Ray Tube (CRT), comprising:

a shadow mask including a plurality of beam passage holes; and a frame including a supporting portion with a pair of long sides and a pair of short sides attached to the shadow mask and a strength maintenance portion bent and arranged from the supporting portion;

wherein the frame includes a plurality of reinforcement indentations arranged on a portion of a boundary between the supporting portion and the strength maintenance portion; and wherein at least one of the reinforcement indentations satisfy the following conditions:

$$a \le \frac{L_H}{6},\ b \ge \frac{L_H}{3}$$

$$a' \le \frac{L_V}{5},\ b' \ge \frac{3}{10}L_V$$

wherein a and b respectively represent a distance from the end of the long side to one side and the other side of the reinforcement indentation located on the long side, a' and b' respectively represent a distance from the end of the short side to one side and the other side of the reinforcement indentation located on the short side, and LH and LV respectively represent a length of the long side and the short side of the frame.

2. The mask assembly for a CRT of claim 1, wherein the reinforcement indentations comprise:

first indentations arranged on a center of the long side and the short side of the frame;

second indentations arranged next to and at a predetermined distance from the first indentation; and third indentations arranged on four corners of the frame;

wherein at least one of the second indentations satisfies at least one of the conditions.

3. The mask assembly for a CRT of claim 2, wherein the first indentations and the second indentations are elongated in a straight line, and wherein the third indentations are L-shaped and adapted to wrap around the corners of the frame.

4. The mask assembly for a CRT of claim 2, wherein the reinforcement indentations have heights according to a direction of the width of the supporting portion, and wherein the height of the third indentations is less than that of the first and the second indentations.

5. The mask assembly for a CRT of claim 2, wherein the reinforcement indentations have protrusion depths according to the direction of the width of the strength maintenance portion, and wherein the second indentations have greater protrusion depth than that of the third indentations, and the third indentations have greater protrusion depth than that of the first indentations.

6. The mask assembly for a CRT of claim 2, wherein at least one of the second indentations satisfies the following condition:

$$\frac{S_1}{3} \le S_2 \le \frac{2}{3}S_1$$

wherein $S_1$ represents an area of a triangle defined by a width of the supporting portion comprising the second indentation, a width of the strength maintenance portion comprising the second indentation and an imaginary line connecting an end of the supporting portion and an end of the strength maintenance portion, and wherein $S_2$ represents the sectional area of the second indentation.

7. A mask assembly for a Cathode Ray Tube (CRT), comprising:

a shadow mask including a plurality of beam passage holes; and a frame including a supporting portion with a pair of long sides and a pair of short sides fixed to the shadow mask and a strength maintenance portion bent and arranged from the supporting portion;

wherein the frame includes a plurality of reinforcement indentations arranged on a portion of the boundary between the supporting portion and the strength maintenance portion; and wherein at least one of the reinforcement indentations satisfies the following conditions:

$$\frac{S_1}{3} \leq S_2 \leq \frac{2}{3}S_1$$

wherein $S_1$ represents an area of a triangle defined by a width of the supporting portion comprising a reinforcement indentation, a width of the strength maintenance portion comprising the reinforcement indentation and an imaginary line connecting an end of the supporting portion and an end of the strength maintenance portion, and wherein $S_2$ represents a sectional area of the reinforcement indentation.

8. The mask assembly for a CRT of claim 7, wherein the reinforcement indentation comprises first indentations arranged on a center of the long side and the short side of the frame and second indentations arranged next to and at a predetermined distance from the first indentations and third indentations arranged on four corners of the frame, and wherein at least one of the second indentations satisfies the condition.

9. The mask assembly for a CRT of claim 8, wherein the first indentations and the second indentations are elongated in a straight line, and wherein the third indentations are L-shaped and adapted to wrap around the corners of the frame.

10. The mask assembly for a CRT of claim 8, wherein the reinforcement indentations have heights according to a direction of the width of the supporting portion, and wherein the height of the third indentations is less than that of the first and the second indentations.

11. The mask assembly for a CRT of claim 8, wherein the reinforcement indentations have protrusion depths according to the direction of the width of the strength maintenance portion, and wherein the second indentations have greater protrusion depth than that of the third indentations, and the third indentations have greater protrusion depth than that of the first indentations.

12. The mask assembly for a CRT of claim 8, wherein at least one of the second indentations arranged on the long side of the frame satisfies the following condition:

$$a \leq \frac{L_H}{6},\ b \geq \frac{L_H}{3}$$

wherein a and b respectively represent a distance from an end of the long side to one side and the other side of the second indentations, and wherein $L_H$ represents a length of the long side of the frame.

13. The mask assembly for a CRT of claim 8, wherein at least one of the second indentations arranged on the short side of the frame satisfies the following condition:

$$a' \leq \frac{L_V}{5},\quad b' \geq \frac{3}{10}L_V$$

wherein a' and b' respectively represent a distance from an end of the short side to one side and the other side of the second indentations, and wherein $L_V$ represents a length of the short side of the frame.

* * * * *